US006706167B1

(12) United States Patent
Pearson et al.

(10) Patent No.: US 6,706,167 B1
(45) Date of Patent: Mar. 16, 2004

(54) ZINC AND ZINC ALLOY ELECTROPLATING ADDITIVES AND ELECTROPLATING METHODS

(76) Inventors: Trevor Pearson, Macdermid Canning PLC, P.O. Box 288, Great Hampton Street, Birmingham (GB), B18 6AS; Alan Peter Swales, 90 Earlswood Road, Dorridge, Solihull, West Midlands (GB), B93 8RN ( * ) Notice: Subject to any disclaimer, the term of this patent is extended or adjusted under 35 U.S.C. 154(b) by 0 days.

(21) Appl. No.: 09/674,105

(22) PCT Filed: Feb. 21, 2000

(86) PCT No.: PCT/GB00/00592

§ 371 (c)(1),
(2), (4) Date: Mar. 7, 2001

(87) PCT Pub. No.: WO00/50669

PCT Pub. Date: Aug. 31, 2000

(30) Foreign Application Priority Data

Feb. 25, 1999 (GB) ..... 9904292
Jun. 19, 1999 (GB) ..... 9913968

(51) Int. Cl.[7] ..... C25D 3/56

(52) U.S. Cl. ..... 205/244; 205/311; 205/245; 205/308; 205/312; 205/313; 205/314; 106/1.29

(58) Field of Search ..... 106/1.29; 205/244, 205/245, 305, 307, 308, 309, 310, 311, 312, 313, 314

(56) References Cited

U.S. PATENT DOCUMENTS

| | | | |
|---|---|---|---|
| 3,790,400 | A | 2/1974 | Kuzmik |
| 5,405,523 | A | 4/1995 | Eckles |
| 5,435,898 | A | 7/1995 | Commander et al. |
| 5,569,724 | A | 10/1996 | Hendricks et al. |

FOREIGN PATENT DOCUMENTS

| | | | |
|---|---|---|---|
| CA | 2215048 | | 9/1996 |
| EP | 0 815 291 | | 4/1999 |
| GB | 1507096 | * | 4/1978 |
| WO | WO 96/28590 | | 9/1996 |
| WO | WO 99/31301 | | 6/1999 |

OTHER PUBLICATIONS

International Search Report for International Application No. PCT/GB 00/00592 mailed on Aug. 24, 2000.

* cited by examiner

*Primary Examiner*—Wesley A. Nicolas
(74) *Attorney, Agent, or Firm*—Carmody & Torrance LLP

(57) ABSTRACT

A polymer additive for alkaline zinc and zinc alloy electrodepositing media and processes comprises the reaction product of one or both of (i) a first di-tertiary amine of the formula:

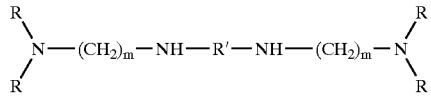

where R' represents

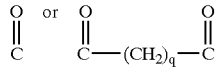

and q is 2 to 6,
R represents $CH_3$ or $C_2H_5$ and each R may be the same or different
and m is 2 to 4, and
a second di-tertiary amine of the formula:

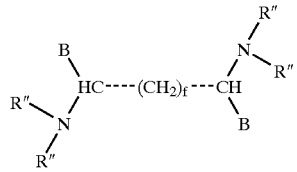

where B is $C_gH_{2g+1}$ and g=0 or an integer the respective B groups being the same or different, and f=0 o an integer, and
R" represents $CH_3$ or $C_2H_5$ and each R" may be the same or different, with (ii) a di-halo alkane of the formula:

$A—(CH_2)_n—A$ where A represents a halogen atom and n is at least 2.

The resulting polymer preferably has the general structure:

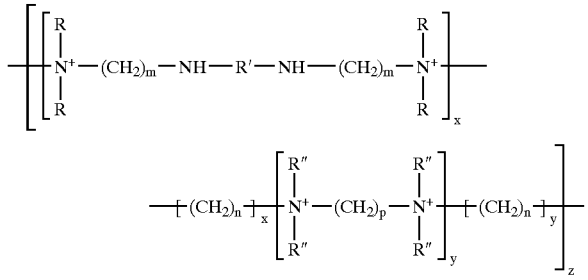

$(2x + 2y)\ A^-$

Where: $0 \leqq x \leqq 1$ $0 \leqq y \leqq 1$ and: either (x or y) or (x and y)=1 z is at least 2 and when y=0, n is at least 3.

26 Claims, No Drawings

ZINC AND ZINC ALLOY ELECTROPLATING ADDITIVES AND ELECTROPLATING METHODS

The present invention relates generally to improvements in the electrodeposition of zinc and zinc alloys from aqueous alkaline plating baths and to new additives for use in such electrodeposition processes.

Electrodeposition of zinc and zinc alloys, based for example on sodium zincate, has been known for many years. It is not possible to produce a commercially acceptable deposit from a simple sodium zincate electrolyte as the deposit is powdery and dendritic. For this reason, various additives have been proposed to provide improved deposition, such as cyanides (which have obvious environmental problems) and polymers of amines and epichlorohydrin which act as grain refining additives. These polymers are limited to usage in baths having relatively low concentrations of zinc because it is not possible to prevent uncontrolled deposition of zinc at higher metal concentrations. Also, electroplating processes using these additives tend to have poor cathode efficiency, a narrow bright range, a narrow operating window and tend to produce pitted and "burnt" deposits. More recently, additives have been proposed which allow higher zinc concentrations to be used, which have significantly reduced burning and pitting and which allow a wider range of operating parameters. Further, the additives enable an excellent deposit distribution (that is, evenness of the deposit across the article being plated, irrespective of its shape in particular areas). This maximises the efficiency of zinc usage. These additives are based generally on polyquaternary amine compounds and are described in U.S. Pat. No. 5,435,898 and U.S. Pat. No. 5,405,523, which also provide further discussion of the prior art.

U.S. Pat. No. 5,435,898 describes polymers for use as additives in the electrodeposition of zinc and zinc alloys, the polymers having the general formula:

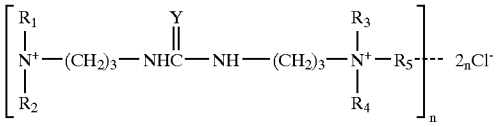

$R_1$ to $R_4$ may be the same or different and are, inter alia, methyl, ethyl or isopropyl and Y may be S or O. $R_5$ is an ether linkage such as $(CH_2)_2$—O—$(CH_2)_2$.

U.S. Pat. No. 5,405,523 claims ureylene quaternary ammonium polymers in general as brightening agents in zinc alloy electroplating baths. The preferred and exemplified polymers include units of the general formula:

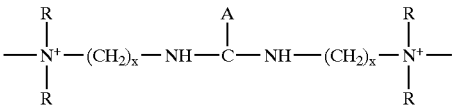

where A may be O, S or N and R may be, inter alia, methyl, ethyl or isopropyl. In the preferred polymers, these units are linked by units derived from, for example a bis(2-haloethyl) ether, a (halomethyl) oxirane or a 2, 2'-(ethyleredioxy)-diethylhalide. Ethylene dihalides such as ethylene dichloride and ethylene dibromide are also suggested but not exemplified.

Further known additives are polycationic compositions based on polymerisation of dimethyl-diallyl ammonium chloride with sulphur dioxide as described in DE 19,509,713.

However, the overall cathodic efficiency of these processes can be low and the resultant deposits may be unsatisfactory in terms of brightness and levelling.

The present invention provides improved polymers for use as additives in the electrodeposition of zinc and zinc alloys. In particular, it has been found that by avoiding an ether-type linkage such as $R_5$ in the prior art above, a brighter deposit may be obtained which is also easier subsequently to apply conversion coatings.

The present invention is thus concerned with electrodeposition on a variety of electrically conducting substrates in a medium which may provide improved cathode efficiency and/or improved brightness and/or a more stable finish which is suitable for further treatment. Suitable substrates include iron and all ferrous-based substrates (including both iron alloys and steels), aluminium and its alloys, magnesium and its alloys, copper and its alloys, nickel and its alloys, and zinc and its alloys. Aluminium and its alloys and ferrous-based substrates are particularly preferred substrates, with steels being most preferred.

In its broadest sense, the invention provides polymers for use as additives in the electrodepostion of zinc and zinc alloys, and processes employing the polymers, the polymers being obtained by the reaction of one or both of:

(a) a di-tertiary amine containing an amide functional group and (b) a di-tertiary amine containing an alkyl group, with (c) a di-halo alkane, to form a random co-polymer.

The present invention also relates to a method of coating an electrically conducting substrates with zinc or zinc alloy by electrodeposition from a bath medium comprising of an effective amount of the reaction product of one or both of: (a) di-tertiary amine containing an amide functional group and (b) a di-tertiary amine containing an alkyl group, with (c) a di-halo alkane, to form a random co-polymer, a source of zinc ions and optionally additional metal ions of one of more alloying metals, and a chelating agent to render the ions soluble.

The di-tertiary amine (a) containing an amide functional group in the polymer of the invention has the general formula:

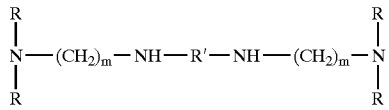

(1)

where R' represents

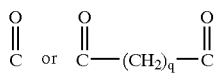

and q is 2 to 6,

R is $CH_3$ or $C_2H_5$ and each R may be the same or different, and m is 2 to 4.

An example of a suitable ditertiary amine of Formula (1) is N,N'-bis[3-(dimethylamino)propyl]urea.

The ditertiary amine (b) containing an alkyl group has the general formula:

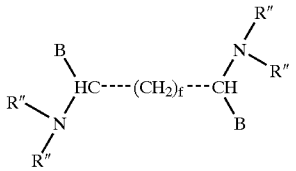

where B is $C_gH_{2g+1}$ and g=0 or an integer the respective B groups being the same or different, and f=0 o an integer, and R" is $CH_3$ or $C_2H_5$ and each R" may be the same or different. Thus, the amine groups may be terminal or branched with respect to the alkyl chain portion. Preferably, however, the amine groups are terminal, as indicated by the general formula:

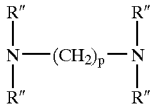

(3)

where R" is $CH_3$ or $C_2H_5$ and each R" may be the same or different, and p is at least 2.

Examples of suitable di-tertiary amines of Formula (2) include N,N,N',N'-tetramethyl-1,6-hexanediamine, N,N,N'N'-tetramethyl-1,3-propane diamine and N,N,N',N'-tetramethyl-1,3 butane diamine.

The dihaloalkane (c) may be represented by the general formula:

$$A—(CH_2)_n—A \quad (4)$$

where A represents a halogen atom, especially chlorine or bromine and most preferably chlorine, and n is at least 2, provided that if the monomer of formulas (2) or (3) above is absent, n is at least 3.

Examples of the dihaloalkanes of formula (4) include 1,4-dichlorobutane, 1,5-dichloropentane, 1,6-dichlorohexane and 1,3-dichlorobutane. The latter is believed to result in a polymer additive which is less effective than those dihaloalkanes where the halogen atoms are in terminal positions only.

The upper limit of n (formula (4)) p (formula (3)) or f and g (formula (2)) respectively is determined by the the need for the resultant polymer to be soluble in the electroplating bath. In practical terms, it is envisaged that the upper limit of n and p respectively will be about 8, that f will be not more than 6 and that g will not be more than 3 as higher values produce polymers of insufficient solubility.

The resultant polymer additive according to the present invention may be represented by the formula:

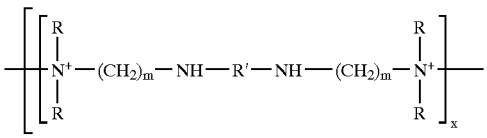

-continued

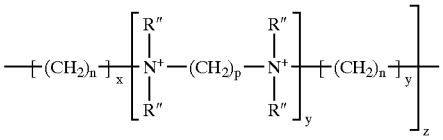

$(2x + 2y)\ A^-$

Where: $0 \leqq x \leqq 1$ $0 \leqq y \leqq 1$ and either (x or y) or (x and y)=1 z is at least 2 and when y=0, n is at least 3.

In practice, it may be difficult to produce polymers where n and p both have a value of 2 and also x is 0. For this reason, when x=0, it is preferred that the sum n+p is at least 6.

In the polymer additive of the invention the di-tertiary amine unit containing an amide functional group may be absent (i.e. when x=0) or the di-tertiary amine unit containing an alkyl group may be absent (i.e. y=0), but one or other of these units must be present. Preferably, both units are present. The polymer of the invention when both the above mentioned units are present is a random co-polymer such that the respective di-tertiary amine units appear in random sequence (in all cases linked by the di-halo alkane residue).

The absolute value of z is not specified as the polymer of the invention will normally comprise polymer molecules of a range of molecular weights. For individual polymer molecules z will generally be at least 4 to 20 and may be as high as 100 or more.

Also, the molar ratio in the polymer of the di-tertiary amine units derived from formulas (1) and (2) respectively may be selected as desired in order to achieve particular properties. Thus, a polymer in which y=0 results in a zinc electrodeposition process producing a very bright deposit with good distribution (even coating) but the cathode efficiency is not as high as may be desirable. A polymer where both x and y are greater than 0 provides good brightness and good distribution, together with good cathode efficiency. Preferably, the molar ratio of the di-tertiary amines derived from formulae (1) and (2) is in the range of 25:75 to 75:25. More preferably, the ratio is 50:50 to 75:25, and most especially 62.5:37.5.

For the di-tertiary amine of formula (1), R' is preferably

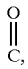

but when R' is

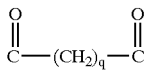

q is preferably 4 to 6. Further R (irrespective of R') is particularly preferably $CH_3$.

In the di-tertiary amine represented by formula (2) R" is preferably $CH_3$ and L is preferably 2 to 4 so that in formula (3), p is preferably 4 to 6.

For the dihaloalkane of formula (4), n is preferably in the range of 4 to 6.

The following examples are illustrative of preparation techniques for polymers according to the invention.

EXAMPLE 1

N,N'-Bis[3-(dimethylamino)propyl]urea (15.0 grams), 1,4-dichlorobutane (8.3 grams) and water (23.3 grams) are introduced into to a reaction flask equipped with a reflux condenser, thermometer and stirrer. The reagents are stirred and heated to reflux until the reaction progresses sufficiently towards completion. A reflux of 4 to 5 hours or more is suitable. The resulting liquid is allowed to cool to room temperature giving an aqueous solution of the desired product. In these examples, 100% completion of the reaction tray not be achievable or necessary and the reflux time may be varied accordingly.

EXAMPLE 2

N,N'-Bis[3-(dimethylamino)proply]urea (6.3 grams), N,N,N',N'-tetramethyl-1,6-hexanediamine (4.7 grams), 1,4-dichiorobutane (6.9 grams) and water (18.0 grams) are introduced into a reaction flask equipped with a reflux condenser, thermometer and stirrer. The reagents are stirred and heated to reflux for a sufficient time to achieve the required degree of completion of the reaction, typically at least 5 hours. The resulting liquid is allowed to cool to room temperature giving an aqueous solution of the desired product.

EXAMPLE 3

N,N,N',N'-tetramethyl-1,6-hexanediamine (10.0 grams), 1,5-dichloropentane (8.1 grams) and water (18.1 grams) are introduced into to a reaction flask equipped with a reflux condenser, thermometer and stirrer. The reagents are stirred and heated to reflux for a sufficient time to achieve the required degree of completion of the reaction, typically at least 7 hours. The resulting liquid is allowed to cool to room temperature giving an aqueous solution of the desired product.

EXAMPLE 4

N,$N^1$-Bis[3-(dimethylamino)propyl]urea (9.0 grams), N,N,N',N'-tetramethyl-1,3-propanediamine (5.1 grams), 1,6-dichlorohexane (12.1 grams) and water (26.2 grams) are introduced into to a reaction flask equipped with a reflux condenser, thermometer and stirrer. The reagents are stirred and heated to reflux for a sufficient time to achieve the required degree of completion of the reaction, typically at least 8–10 hours. The resulting liquid is allowed to cool to room temperature giving an aqueous solution of the desired product.

The polymer additives according to the invention can provide excellent results in zinc or zinc alloy electroplating processes when used on their own. Further benefits may be obtained by combination of the polymer additive of the invention with known further additives, such as those indicated in the groups below:

Group 1: Polymers according to the invention

Group 2: Additives selected from the following:
Silicate, tartrate, gluconate, heptonate or other hydroxy acids Group 3: N-Benzyl Niacin and/or bath soluble aromatic aldehydes and their bisulphite adducts Group 4: Imidazole/epihalohydrin polymers or other amine/epihalohydrin polymers Preferably, one compound from each group is present in the plating bath medium in an effective amount.

The following examples are illustrative of zinc and zinc alloys electroplating media and processes employing the polymer additives of the present invention. The following examples relate to electrodepostion experiments which were performed on mild steels, i.e. a ferrous based substrate. However, the procedures described in these examples are equally suitable for electrodeposition onto aluminium and its alloys, magnesium and its alloys, copper and its alloys, nickel and its alloys, and zinc and its alloys.

EXAMPLE A

An aqueous electrolyte suitable for plating zinc was prepared containing 12 g/l Zinc (as metal) and 135 g/l NaOH. A Hull cell test was performed on this electrolyte at 1A for 10 minutes. The resultant deposit was black and powdery and was not suitable for commercial use. 3 ml/l of the product formed in example 1 was added to the electrolyte. A 1A Hull cell test now gave a semi-bright deposit of zinc at current densities of 0.5 to 5 A/$dm^2$.

EXAMPLE B

An aqueous electrolyte suitable for plating zinc was prepared containing 12 g/l Zinc (as metal) and 135 g/l NaOH. 3 ml/l of the product of example 2 was added and a Hull cell test was performed. A semi-bright deposit was formed at current densities of 0.1 to 4 A/$dm^2$.

EXAMPLE C

An aqueous electrolyte suitable for plating zinc was prepared containing 12 g/l Zinc (as metal) and 135 g/l NaOH. 3 ml/l of the product of example 3 was added and a Hull cell test was performed. A dull but fine grained deposit was formed at current densities of 0.05 to 5 A/$dm^2$.

EXAMPLE D

An aqueous electrolyte suitable for plating zinc was prepared containing 12 g/l Zinc (as metal) and 135 g/l NaOH. 3 ml/l of the product of example 4 was added and a Hull cell test was performed. A semi-bright deposit was formed at current densities of 0.1 to 4 A/$dm^2$.

EXAMPLE E

An aqueous electrolyte suitable for plating zinc was prepared containing 12 g/l Zinc (as metal) and 135 g/l NaOH. 3 ml/l of the product of example 2,0.5 ml/l of an imidazole/epichlorohydrin polymer (Lugalvan ES 9572 from BASF),0.05 g/l of N-Benzyl Niacin and 8 g/l of sodium silicate was added to the electrolyte. A 1 amp Hull cell test performed on this electrolyte produced a fully bright lustrous deposit over the entire current density range of the Hull cell panel. The thickness of the deposit obtained on this panel was at least 25% greater than that obtained from a comparative panel produced from an electrolyte prepared as above but substituting an equivalent concentration of Mirapol WT (a polymer as described in U.S. Pat. No. 5,435,898) for the product of example 2.

EXAMPLE F

An aqueous electrolyte suitable for plating zinc was prepared containing 12 g/l Zinc (as metal) and 135 g/l NaOH. 3 ml/l of the product of example 2,0.5 ml/l of an imidazole/epicholohydrin polymer (Lugalvan ES 9572), 0.05 g/l of N-Benzyl Niacin and 1 g/l of sodium potassium tartrate was added to the electrolyte. A 1 amp Hull cell test performed on this electrolyte produced a fully bright lustrous deposit over the entire current density range of the Hull cell panel.

EXAMPLE G

An aqueous electrolyte suitable for plating zinc was prepared containing 12 g/l Zinc (as metal) and 135 g/l NaOH. 3 ml/l of the product of example 3,0.5 ml/l of an imidazole/epichlorohydrin polymer (Lugalvan ES 9572), 0.05 g/l of N-Benzyl Niacin and 8 g/l of sodium silicate was added to the electrolyte. A 1 amp Hull cell test performed on this electrolyte produced a fully bright lustrous deposit over the current density range of 0.05 to 4 A/dm$^2$.

EXAMPLE H

An aqueous electrolyte suitable for plating a zinc/iron alloy was prepared containing 12 g/l Zinc (as metal), 135 g/l NaOH, 60 g/l sodium heptonate and 100 mg/l of iron. 3 ml/l of the product of example 2,0.5 ml/l of an imidazole/epichlorohydrin polymer (Lugalvan ES 9572) and 0.05 g/l of N-Benzyl Niacin was added to the electrolyte. A 1 amp Hull cell test performed on this electrolyte produced a fully bright lustrous deposit over the entire current density range of the Hull cell panel. Passivation of the Hull cell panel in a chromating bath containing chromic acid, sulphuric acid, phosphoric acid and other inorganic salts produced a uniform black coating thus indicating uniform co-deposition of iron over the Hull cell panel.

EXAMPLE I

An aqueous electrolyte suitable for plating a zinc/cobalt/iron alloy was prepared containing 12 g/l Zinc (as metal), 135 g/l NaOH, 60 g/l sodium heptonate and 50 mg/l of iron and 80 mg/l cobalt. 3 ml/l of the product of example 2,0.5 ml/l of an imidazole/epichlorohydrin polymer (Lugalvan ES 9572) and 0.05 g/l of N-Benzyl Niacin was added to the electrolyte. A 1 amp Hull cell test performed on this electrolyte produced a fully bright lustrous deposit over the entire current density range of the Hull cell panel. Passivation of the Hull cell panel in a chromating bath containing chromic acid, sulphuric acid, phosphoric acid and other inorganic salts produced a uniform black coating thus indicating uniform co-deposition of cobalt and iron over the Hull cell panel. Subsequent analysis of the deposit by energy dispersive X-ray analysis showed a cobalt concentration of 0.4% over a wide range of current densities.

EXAMPLE J

An aqueous electrolyte suitable for plating zinc was prepared containing 12 g/l Zinc (as metal) and 135 g/l NaOH. 3 ml/l of the product of example 2,0.5 ml/l of an imidazole/epichlorohydrin polymer (Lugalvan ES 9572)), 0.1 g/l of Veratraldehyde (3,4-dimethoxybenzaldehyde) and 1 g/l of sodium potassium tartrate was added to the electrolyte. A 1 amp Hull cell test performed on this electrolyte produced a bright but slightly hazy deposit over the entire current density range of the Hull cell panel.

The present invention further relates to a polymer additive for an alkaline zinc or zinc alloy electroplating bath medium comprising the reaction product of one or both of:

(i) a first di-tertiary amine of the formula:

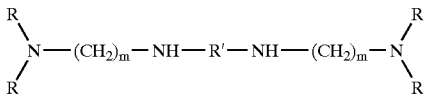

(1)

where R' represents

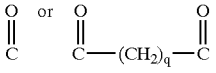

and q is 2 to 6,

R represents $CH_3$ or $C_2H_5$ and each R may be the same or different and m is 2 to 4, and a second di-tertiary amine of the formula:

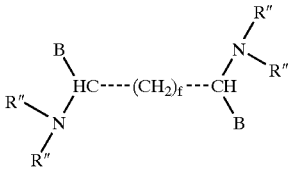

What is claimed is:

1. A polymer additive for an alkaline zinc or zinc alloy electroplating bath medium comprising a reaction product of one or both of:

(i) a first di-tertiary amine of formula (1) as follows:

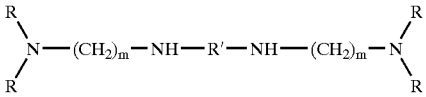

(1)

where R' is selected from

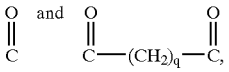

q is valued from 2 to 6, each R is selected from the group consisting of $CH_3$ and $C_2H_5$, wherein each R may be the same or different, and m is valued from 2 to 4, and a secondary di-tertiary amine of formula (2) as follows:

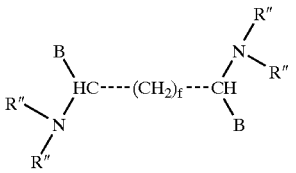

wherein B group is $C_gH_{2g+1}$ and g=0 or an integer, wherein each B group may be the same or different, f=0 or an integer, and each R" is selected from the group consisting of $CH_3$ and $C_2H_5$, and each R" may be the same or different, with (ii) a di-halo alkane of the formula (3) as follows:

$$A—(CH_2)_n—A \quad (3)$$

wherein A represents a halogen atom and n is valued to be at least 2, provided that when the second di-tertiary amine of formula (2) is absent, n is valued to be at least 3;

wherein moieties derived from the first di-tertiary amine and/or the second di-tertiary amine are present in a ratio of from approximately 25:75 to approximately 75:25.

2. A polymer additive according to claim 1, wherein the second di-tertiary amine has the general formula 4 as follows:

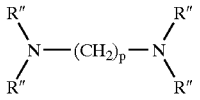

(4)

wherein p is valued to be at least 2.

3. A polymer additive according to claim 2, wherein p is valued at 8 or less.

4. A polymer additive according to claim 1 comprising a random co-polymer of general formula:

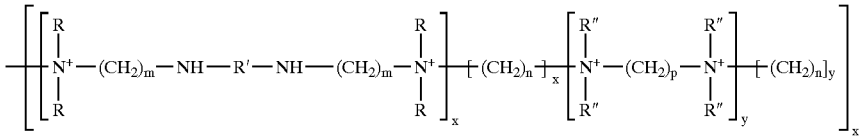

$(2x+2y)A—$

Where: $0 \leqq x \leqq 1$ $0 \leqq y \leqq 1$ and: either (x or y) or (x and y)=1 z is at least 2 and when y=0, n is at least 3.

5. A polymer additive according to claim 4, wherein n is not more than 8.

6. A polymer additive according to claim 1, wherein f is not more than 6 and/or g is not more than 3.

7. A polymer additive according to claim 1, wherein R is $CH_3$.

8. A polymer additive according to claim 1, wherein R" is $CH_3$.

9. A polymer additive according to claim 1, wherein f is valued from 2 to 4.

10. A polymer additive according to claim 3, wherein p is valued from 4 to 6.

11. A polymer additive according to claim 1, wherein R' is

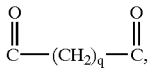

and q is valued from 4 to 6.

12. A polymer additive according to claim 1, wherein the second di-tertiary amine is N,N,N',N'-tetramethyl-1,6-hexanediamine.

13. A polymer additive according to claim 1, wherein the di-halo alkane is 1,4-dichlorobutane.

14. An aqueous alkaline zinc or zinc alloy bath medium for depositing zinc or zinc alloys, the medium comprising a source of zinc ions; and, in the case of the alloy comprising alloying metals, a source of additional metal ions of the alloying metals; a suitable chelating agent to render the ions soluble; and a functional amount of the polymer additive according to claim 1.

15. A bath medium according to claim 14, wherein the alloying metal is selected from the group consisting of iron, cobalt, nickel, and combinations thereof.

16. A bath medium according to claim 14, wherein the source of zinc ions is selected from the group consisting of sodium zincate and potassium zincate.

17. A bath medium according to claim 16, wherein the zinc is present in an amount of 5 to 35 g/l.

18. A bath medium according to claim 14, wherein alkalinity is provided by sodium hydroxide or potassium hydroxide in an amount of 50 to 200 g/l.

19. A bath medium according to claim 14, wherein the polymer additive is present in an amount of 0.5 to 5 g/l.

20. A bath medium according to claim 14, further comprising an effective amount of an additional additive selected from the group consisting of silicates; gluconate, heptonate, and tartrate; N-Benzyl Niacin; aromatic aldehydes and their bisulphate adducts; and amine/epihalodrin polymers.

21. A process for electrodepositing zinc and/or zinc alloys on a conductive substrate, the process comprising: contacting the substrate with an aqueous alkaline zinc or zinc alloy bath medium for depositing zinc or zinc alloys, the medium comprising a source of zinc ions; and, in the case of the alloy comprising alloying metals, a source of additional metal ions of the alloying metals; a suitable chelating agent to render the ions soluble; and a functional amount of a polymer additive comprising a reaction product of one of both of:

(i) a first di-tertiary amine of formula (1) as follows:

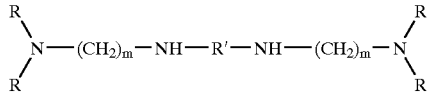

(1)

where R'is selected from

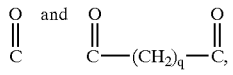

q is valued from 2 to 6,

Each R is selected from $CH_3$ and $C_2H_5$, wherein each R may be the same or different, and m is valued from 2 to 4, and a secondary di-tertiary amine of formula (2) as follows:

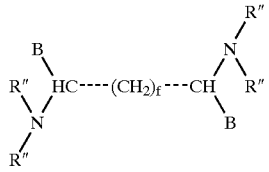

wherein B group is $C_gH_{2g+1}$ and g=0 or an integer, wherein each B group may be the same or different, f=0 or an integer, and each R" is selected from $CH_3$ and $C_2H_5$, and each R" may be the same or different, with (ii) a di-halo alkane of the formula (3) as follows:

$A—(CH_2)_n—A$ (3)

wherein A represents a halogen atom and n is valued to be at least 2, provided that when the second di-tertiary amine of formula (2) is absent, n is valued to be at least 3, and electrodepositing zinc or zinc alloys on the substrate; and wherein moieties derived from the first di-tertiary amine and the second di-tertiary amine are present in a ratio of from approximately 25:75 to approximately 75:25.

22. A process according to claim 21, wherein the conductive substrate is steel.

23. A polymer additive according to claim 1, wherein the first di-tertiary amine is N,N'-bis(3-dimethylamino)propyl) urea.

24. A polymer additive for an alkaline or zinc alloy electroplating bath medium comprising a reaction product of one or both of:

(i) a first di-tertiary amine of formula (1) as follows:

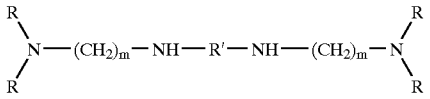

(1)

where R' is selected from

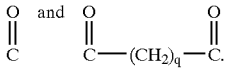

q is valued from 2 to 6, each R is selected from $CH_3$ and $C_2H_5$, wherein each R may be the same or different, and a second di-tertiary amine of formula (2) as follows:

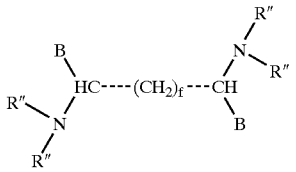

where a B group is $C_gH_{2g+1}$ and g=0 or an integer, wherein each B group may be the same or different, f=0 or an integer, and each R" is selected from $CH_3$ and $C_2H_5$, each R" may be the same or different, with (ii) a di-halo alkane of the formula (3) as follows:

$$A—(CH_2)_n—A \quad (3)$$

where A represents a halogen atom and n is valued to be at least 2, provided that when the second di-tertiary amine of formula (2) is absent, n is valued to be at least 3, and provided that the dihalo alkane is not 1,4-dichlorobutane when the first or the second amine is N,N'-bis(3-amino dimethyl)propyl)urea.

25. A process according to claim 21, wherein the conductive substrate is selected from the group consisting of aluminum and its alloys, ferrous based substrates, magnesium and its alloys, copper and its alloys, nickel and its alloys, and zinc and its alloys.

26. A process for electrodepositing zinc and/or zinc alloys on a conductive substrate, the process comprising:

contacting the substrate with an aqueous alkaline zinc or zinc alloy bath medium for depositing zinc or zinc alloys, the medium comprising a source of zinc ions; and, in the case of the alloy comprising alloying metals, a source of additional metal ions of the alloying metals; a suitable chelating agent to render the ions soluble; and a functional amount of a polymer additive comprising a reaction product of one of both of:

(i) a first di-tertiary amine of formula (1) as follows:

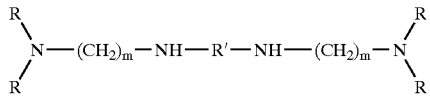

(1)

where R' is selected from

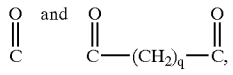

q is valued from 2 to 6,

Each R is selected from $CH_3$ and $C_2H_5$, wherein each R may be the same or different, and m is valued from 2 to 4, and a secondary di-tertiary amine of formula (2) as follows:

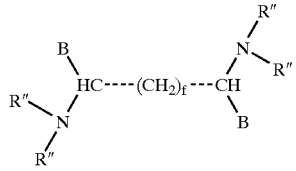

wherein B group is $C_gH_{2g+1}$ and g=0 or an integer, wherein each B group may be the same or different, f=0 or an integer, and each R" is selected from $CH_3$ and $C_2H_5$, and each R" may be the same or different, with (ii) a di-halo alkane of the formula (3) as follows:

$$A—(CH_2)_n—A \quad (3)$$

wherein A represents a halogen atom and n is valued to be at least 2, provided that when the second di-tertiary amine of formula (2) is absent, n is valued to be at least 3; and electrodepositing zinc or zinc alloys on the substrate, such that in the case of an aluminum or aluminum alloy substrate, a dihalo alkane precursor for the bath medium is not 1,4-dichlorobutane when an amine precursor of the bath medium is N,N'-tetramethyl-1,6-diamine hexane, and the dihalo alkane precursor for the bath medium is not 1,6-dibromohexane when the amine precursor for the bath medium is N,N'-bis(3-amino dimethyl)propyl)urea.

* * * * *

UNITED STATES PATENT AND TRADEMARK OFFICE

CERTIFICATE OF CORRECTION

PATENT NO. : 6,706,167 B1
DATED : March 16, 2004
INVENTOR(S) : Trevor Pearson et al.

It is certified that error appears in the above-identified patent and that said Letters Patent is hereby corrected as shown below:

Title page,
Item [30], Foreign Application Priority Data, should read:

-- June 16, 1999 (GB) 9913968 --

Column 9 and 10,
Lines 16-24, the equation should read:

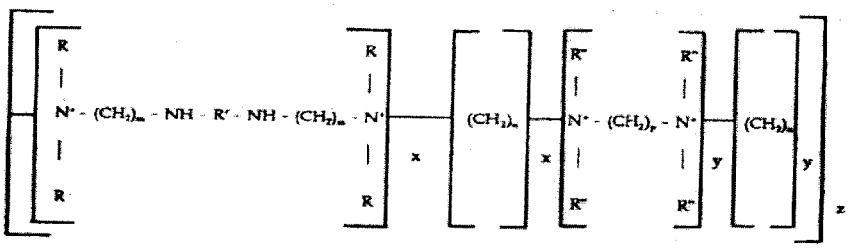

Signed and Sealed this

Fourteenth Day of September, 2004

JON W. DUDAS
*Director of the United States Patent and Trademark Office*